US005582370A

United States Patent [19]

Myers et al.

[11] Patent Number: 5,582,370

[45] Date of Patent: Dec. 10, 1996

[54] SWITCH MACHINE WITH RATCHET MECHANISM ON HAND THROW MECHANISM

[75] Inventors: Steven W. Myers, Palm Beach Gardens, Fla.; Daniel W. Van Alstine, Rochester, N.Y.

[73] Assignee: General Railway Signal Corporation, Rochester, N.Y.

[21] Appl. No.: 293,125

[22] Filed: Aug. 19, 1994

[51] Int. Cl.[6] ..... B61L 5/02

[52] U.S. Cl. ..... 246/406; 246/393; 246/410; 74/523; 74/528; 74/545; 74/546; 74/547; 74/575; 74/577 R; 74/577 M

[58] Field of Search ..... 246/393, 406, 246/410, 411, 412; 74/523, 528, 545, 546, 547, 575, 577 R, 577 M, 578

[56] References Cited

U.S. PATENT DOCUMENTS

| | | | |
|---|---|---|---|
| 1,670,472 | 5/1928 | Millward | 246/410 |
| 3,427,448 | 2/1969 | Redelman | 246/393 |
| 3,599,937 | 8/1971 | Carter | 74/523 |
| 3,875,822 | 4/1975 | Erith et al. | 74/577 M |
| 5,088,694 | 2/1992 | Nishimura | 74/575 |

*Primary Examiner*—S. Joseph Morano
*Attorney, Agent, or Firm*—Ohlandt, Greeley, Ruggiero & Perle

[57] ABSTRACT

There is provided an improved hand throw device of an electric motor driven switch machine having a ratchet mechanism that permits torque to be applied to the hand throw device in either a clockwise or counter-clockwise direction as desired by an operator. The ratchet mechanism is a self contained module that can be easily installed to either side of the switch machine. The ratchet mechanism also permits the operator to assume a favorable position for application of force to the hand throw device with minimum stress and strain to his or her body. In addition, the ratchet mechanism has a gear system that provides a 2 to 1 mechanical advantage so that less torque is required for movement of the hand throw device.

10 Claims, 7 Drawing Sheets

SWITCH MACHINE WITH RATCHET MECHANISM ON HAND THROW MECHANISM

RELATED APPLICATIONS

Reference is made to United States patent applications titled LOW PROFILE SWITCH MACHINE (Attorney Docket No. 11,665 Ser. No. 08/293,121) that relates to art similar to, and commonly owned with, the present application.

BACKGROUND OF THE INVENTION

1. Field of the Invention

The present invention relates generally to a electric motor driven switch machine for switching railroad tracks so that trains may switch from one track to another. More particularly, the present invention relates to an electric motor driven switch machine having a ratchet mechanism on a hand throw means.

2. Description of the Prior Art

It is a requirement for operation of a railroad network to have the capability of switching trains from one track to another. A common method of providing this switching capability is to install an electric motor driven switch machine along side of, and interconnected to, a switch point of a railroad track. These switch machines often have one or more manual operations for shifting the position of the track without the use of the electric motor for certain situations, such as when electric power is not available, or when installation or maintenance action is required.

Two manual operations typically available within switch machines are the hand crank and hand throw operations. The hand crank operation permits operational personnel to switch the track at the switch point by turning a hand crank for maintenance and installation purposes. The hand throw operation permits operational personnel to switch the track, i.e., throw the switch machine, at the switch machine when control signals from a remote facility are not able or not desired to reach the switch machine.

The hand throw operation is performed by controlling a hand throw means that is positioned on the side of the switch machine away from the corresponding railway tracks. This is a safety requirement for operational personnel in order to distance them away from moving rail equipment. Since a switch machine is adaptable for installation on either side of the tracks, depending on installation requirements, the hand throw means must be capable of being removed and installed on either side of the switch machine.

Traditional hand throw devices have hand throw arms that operably rotate 180 degrees. A latch stand at both sides of the hand throw shaft is used to secure the hand throw arm when a hand throw operation has been completed. The hand throw arm is secured to the latch stand with a pad lock to prevent unauthorized use of the hand throw means. The pad lock also provides a reliable indication to accident investigators of the position of the hand throw arm after an accident.

The hand throw means currently used also provides a mode selector device that enables operational personnel to select between a power mode and a hand throw mode for the switch machine. When the power mode is selected, a hand throw operation is not possible. This is a personnel safety feature that prevents a remote operator from energizing the electric motor and operating the switch machine when the hand throw operation is desired. The mode selector device is also secured and locked in the latch stand along with the hand throw arm.

Since existing switch machines with hand throw capabilities require 180 degrees of handle rotation to complete a throw, and the switch machines are typically installed at or near ground level, an operator must lift the hand throw arm upward and then push it over and down to the opposite position. This operation results in stress and strain on the operator's back, spine, joints, muscles and other parts of the body that must exert considerable force in an awkward position without any mechanical aid from the hand throw means.

Lower back injury and the resulting medical treatments, lost labor time and cost of additional personnel have steadily mounted over the years and have become a significant factor in the rising cost of operating a railroad, not to mention the pain and suffering imposed on personnel.

Accordingly, it is a primary object of the present invention to overcome the aforenoted disadvantages associated with the designs of prior art hand throw means by reducing or eliminating the strain required for its operation and reducing the time required to install and maintain the hand throw means, while retaining all of the desired features available in existing hand throw mechanisms.

It is another object of the present invention to provide a self-contained module that contains all machine elements required to perform the hand throw operation, such that the module can be easily bolted to a switch machine when the switch machine is being assembled or after it is installed near railway tracks.

It is still another object of the present invention to provide a module that can be readily repositioned from one side of the switch machine to the other and adjusting its hand throw and to accommodate operation from the new position.

It is yet another object of the present invention to provide a module that contains a gear system having a 2 to 1 mechanical advantage in favor of the hand throw operator.

It is still yet another object of the present invention to provide a ratchet mechanism that permits an operator to raise the hand throw arm to approximately the vertical position before the application of force to the hand throw arm is required.

It is a further object of the present invention to provide a hand throw means that permits an operator to position herself or himself in a favorable position for the application of force without excessive stress and strain to her and his body.

It is a yet further object of the present invention to provide a direction selector for the ratchet mechanism that permits torque to be applied in either a clockwise or counterclockwise direction as desired by the operator.

It is a still further object of the present invention to provide a hand throw means that permits the use of a hand throw mode selector lever for selecting between a hand mode and a power mode selector lever.

It is a still yet further object of the present invention to provide a hand throw means having a hand throw arm that can be returned to a latch stand and secured with a pad lock at the completion of its operation.

SUMMARY OF THE INVENTION

In fulfillment of the above stated and other objects, the problem noted above has been overcome by designing an improved, modular hand throw means that utilizes a ratchet mechanism to facilitate a hand throw operation. The ratchet mechanism permits an operator to move the hand throw arm to a comfortable position and to crank the hand throw arm at the comfortable position until the hand throw operation is complete. Also, the hand throw means includes a 2 to 1 gear ratio to allow the operator to complete the hand throw operation with much less force required to rotate the hand throw arm.

Briefly described then, a preferred embodiment of the present invention is defined as follows. A switch machine for switching railway tracks from one position to another, having a hand throw means for causing a railway track switching operation to occur, the switch machine comprising a drive shaft, a throw shaft located adjacent to the drive shaft for driving the drive shaft, and ratchet means operatively connected to the drive shaft and the throw shaft, including first means for rotating the drive shaft proportional to the rotation of the throw shaft and second means for rotating the throw shaft when the ratchet means is moved in a first direction and allowing the throw shaft to remain stationary when the ratchet means is moved in a second direction.

From another view point of the preferred embodiment, the housing portion of the switch machine is defined as follows: a drive shaft, a first assembly having an aperture for supporting the drive shaft, a second assembly located adjacent to the first assembly for supporting the hand throw means, means, supported by the first and second assemblies, for rotating the drive shaft when the hand throw means is moved in a first direction and allowing the drive shaft to remain stationary when the hand throw means is moved in a second direction, and the first and second assemblies being separable from the switch machine, and from each other, so that the rotating means may be removed and disassembled without disturbing the remaining components of the switch machine.

Other and further objects, features and advantages of the present invention will be understood by reference to the following description in conjunction with the annexed drawings, wherein like parts have been given like numbers.

DETAILED DESCRIPTION OF THE PREFERRED EMBODIMENT

Figure 1:
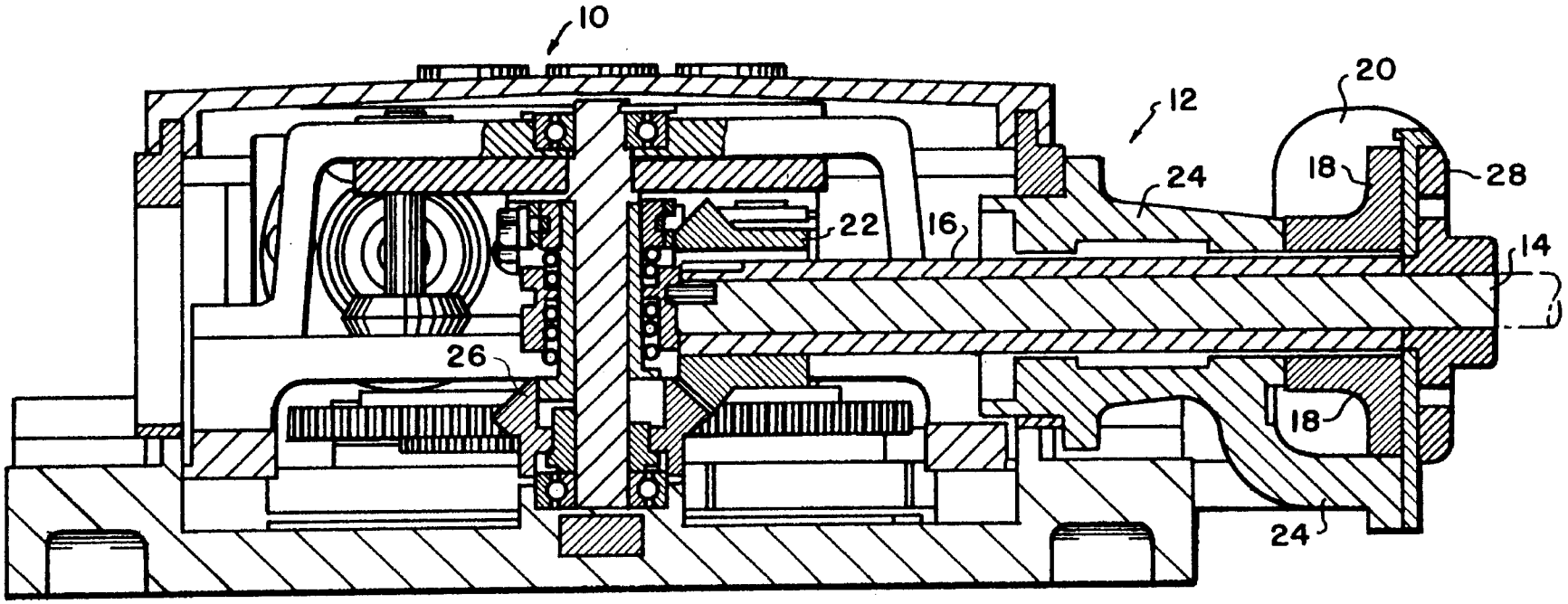
FIG.1 PRIOR ART
FIG. 1 is a cross-sectional view of a switch machine without the ratchet mechanism of the present invention.

Referring to the drawings and, in particular, FIG. 1, there is shown a cross-sectional view of a switch machine 10 having a conventional hand throw means 12. The hand throw means 12 utilizes a dual shaft configuration. A mode selection shaft 14 is rotatably situated within a hollow, tube-like hand throw shaft 16 such that both shafts may rotate 180 degrees, independently of each other. The operation of the mode selection shaft 14 is described in detail within related, copending United States patent applications titled LOW PROFILE SWITCH MACHINE (Attorney Docket No. 11,665, Ser. No. 08/293,121), referred to above.

The hand throw shaft 16 is rotated at one end by an arm gear 18 connected to a hand throw arm 20, whereas the other end is connected to a vertical bevel gear 22. The arm gear 18 is separated from the main body of the switch machine 10 by a support bracket 24. As the hand throw arm 20 is rotated around the axis of the hand throw shaft 16 (up to 180 degrees), the arm gear 18 correspondingly rotates the hand throw shaft 16, and thus the vertical bevel gear 22, at the same rotational velocity. The vertical bevel gear 22 is engaged to a horizontal bevel gear 26 which, in turn, is operatively connected to the main railway track switching mechanism of the switch machine (not shown). Thus, the hand throw operation of a conventional hand throw means 12 simply transfers the 180 degree rotational movement of the hand throw arm 20 to the main switching mechanism.

Figure 2:
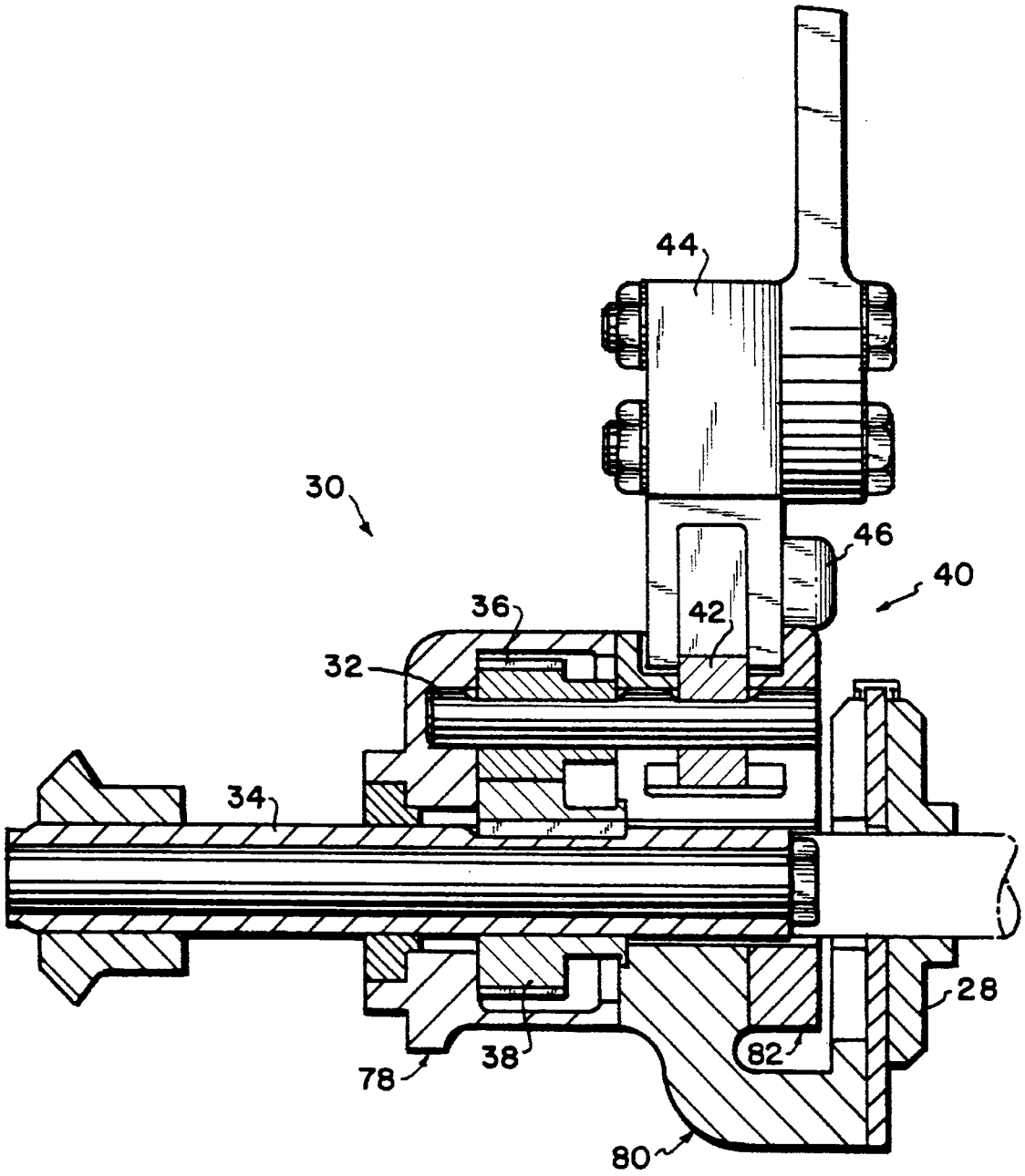
FIG. 2 is cross-sectional view of a switch machine with the ratchet mechanism of the preferred embodiment.

Referring to FIG. 2, there is generally provided a preferred embodiment of the hand throw means 30 of the present invention. For the embodiment shown in FIG. 2, the hand throw means 30 replaces the arm gear 18 and support bracket 24 of the conventional hand throw means 12 of FIG. 1 with a three housing configuration 78, 80 & 82. Also, a throw shaft 32 is included within the hand throw means 30 that is positioned adjacent and substantially parallel to a drive shaft 34. The operations of the throw shaft 32 and the drive shaft 34, in combination, includes all of the operations of the hand throw shaft 16 of the conventional hand throw means 12.

The drive shaft 34 rotates correspondingly to the throw shaft 32 due to an interconnection between a pair of spur gears 36, 38 within the hand throw means 30. A smaller spur gear 36 is situated about one end of the throw shaft 32 and engages a larger spur gear 38 that is situated about a portion of the drive shaft 34. The sizes of the spur gears 36, 38 may vary, depending upon the ratio desired by a manufacturer, in order to provide a suitable and convenient turning ratio for an operator. For example, the larger spur gear 38 may have a circumference that is twice the circumference of the smaller spur gear 36 so that every two rotations of the throw shaft 32 will be required for every one rotation of the drive shaft 34. Since less torque will be required to rotate the throw shaft 32 than the drive shaft 34, the throw shaft 32 is substantially easier to rotate, thus providing a 2 to 1 mechanical advantage in favor of the operator. Although the gear ratio of the hand throw means 30 may vary, as stated above, the remaining description of the preferred embodiment shall referred to the 2 to 1 gear ratio just described for reasons of convenience.

The advantages of having the varied yet proportional gear ratio described above, i.e., the 2 to 1 gear ratio, becomes apparent by understanding the operation of the ratchet mechanism 40 of the present invention. While the smaller spur gear 36 is mounted at one end of the throw shaft 32, a ratchet mechanism 40, and specifically a ratchet pinion 42, is mounted at the other end of the throw shaft 32. The ratchet pinion 42 is driven by a hand throw arm 44 through a pall arrangement that permits the selection of the rotational direction of the ratchet pinion.

Figure 3:
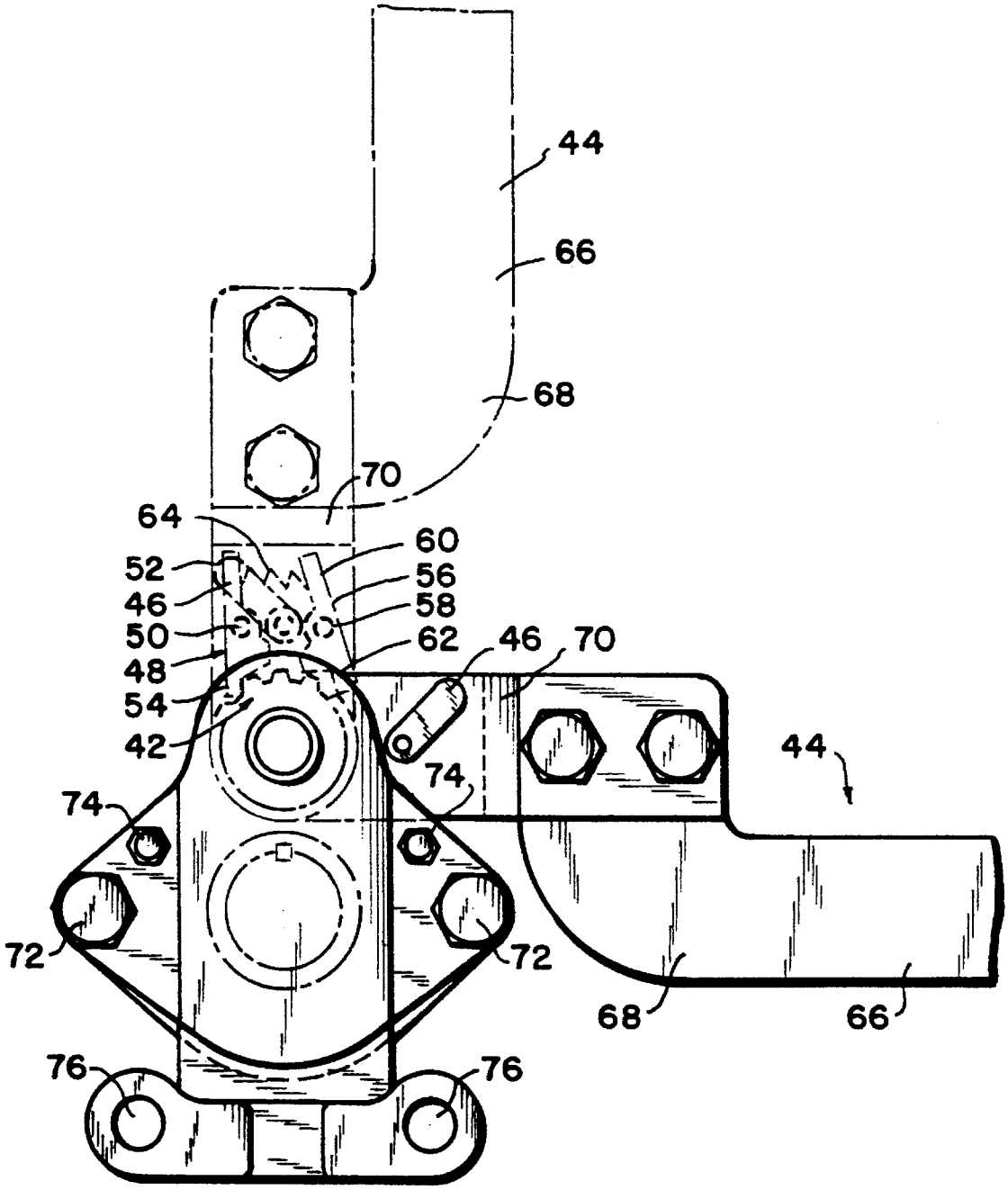
FIG. 3 is a planar side view of the ratchet mechanism of FIG. 2, such that certain components of the mode selector have been omitted.

Referring to FIG. 3, there are shown two possible positions of the hand throw arm 44 of the preferred embodiment. A direction selector 46 is provided to select one of the two drive dogs 48, 56 to be engaged to the ratchet pinion 42. Although not clearly identified in FIG. 3, the ratchet pinion 42 has ragged teeth along its entire circumference. Each drive dog 48, 56 pivots about a near middle portion, i.e., a pivot point 50, and has a spring end 52 opposite its abutment end 54. The spring ends 52, 60 of the drive dogs 48, 56 are forced away from each other by a tension means 64, such as a spring, situated therebetween. Due the force of the tension means 64 and the position of the pivot points 50, 58, the abutment ends 54, 62 of the drive dogs 48, 56 are, correspondingly, normally forced toward each other.

The direction of the ratchet action of the ratchet mechanism is controlled by the position of the direction selector 46. When the direction selector 46 is positioned to the left, as shown in FIG. 3, the abutment end 62 of the right drive dog 56 is shifted outward by the direction selector, thereby clearing the abutment end away from the teeth of the ratchet pinion 42. When the direction selector 46 is at this position, only the left drive dog 48 abuts the teeth of the ratchet pinion 42 and so the hand throw arm 44 may rotate the ratchet pinion in the counter-clockwise direction (from the viewpoint shown in FIG. 3) but not in the clockwise direction. Likewise, when the direction selector 46 is positioned to the right, the hand throw arm 44 may rotate the ratchet pinion 42 in the clockwise direction but not the counter-clockwise direction.

The hand throw arm 44 has a dual-section configuration for adjusting its position with respect to the switch machine 10. An outer section 66 of the hand throw arm 44 has a 90 degree elbow 68 at one end that may be attached to an inner section 70 by two bolts. This feature of the hand throw arm 44 may be necessary in order to properly install the hand throw means 30 of the present invention to existing switch machine 10 designs. For example, the latch stand (not shown) of an existing switch machine 10 is more than likely positioned at a height position that is even with the drive shaft 34, due to the straight arm form of existing hand throw arms 20. Therefore, the vertical position of a new hand throw arm 44 must be adjusted so that it may be locked to a latch stand of an existing switch machine 10. In order to permit the hand throw means 30 of the present invention to be readily moved from one side of the switch machine 10 to the other, the hand throw arm 44 must be angled in the opposite direction when switch to the other side of the switch machine. Thus, the two-section configuration of the hand throw arm 33 allows it to be modified as necessary when the hand throw means 30 is moved to the opposite side.

The hand throw means 30 of the preferred embodiment has two mounting bolts 72 that attach to mounting flanges of the switch machine 10. Also, there are two smaller module bolts 74 that keep the hand throw means 30 together, even when it is not mounted to the switch machine 10. In addition, a face plate (shown in FIG. 2) is mounted to the outer side of the hand throw means 30 at two face plate holes 76 in order to provide it with added protection from outside elements and hazards. The face plate holes 76 are designed to allow the mounting of existing mode selector components 28 to the new hand throw means 30.

Figure 4A:
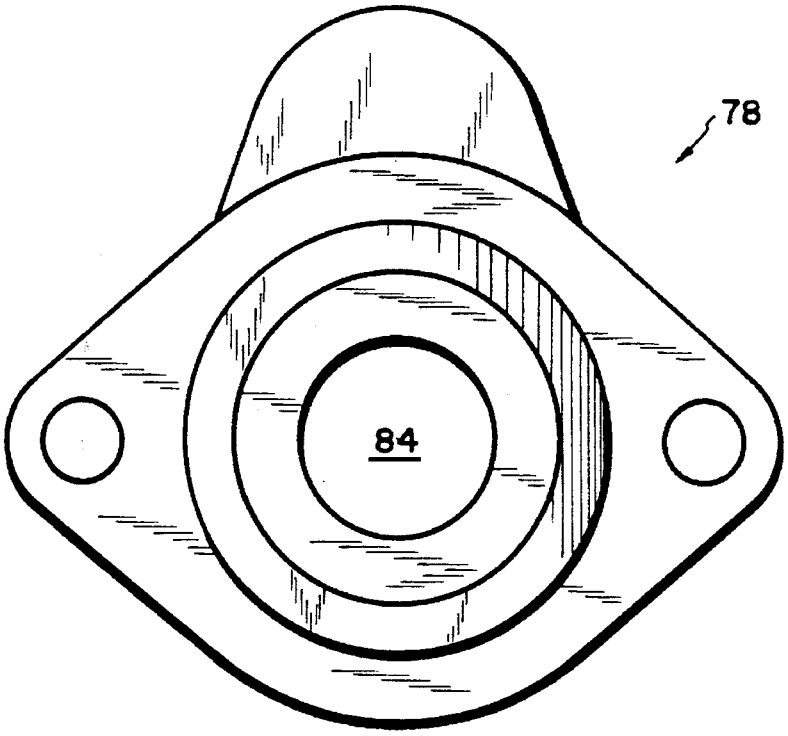
FIG. 4 A through C are planar and cross-sectional views of the first assembly of the preferred embodiment of FIG. 2.
Figure 4B:
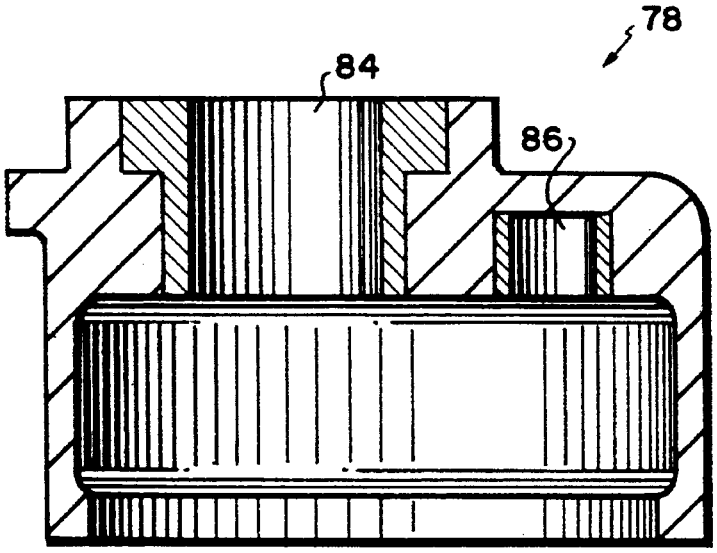
Figure 4C:
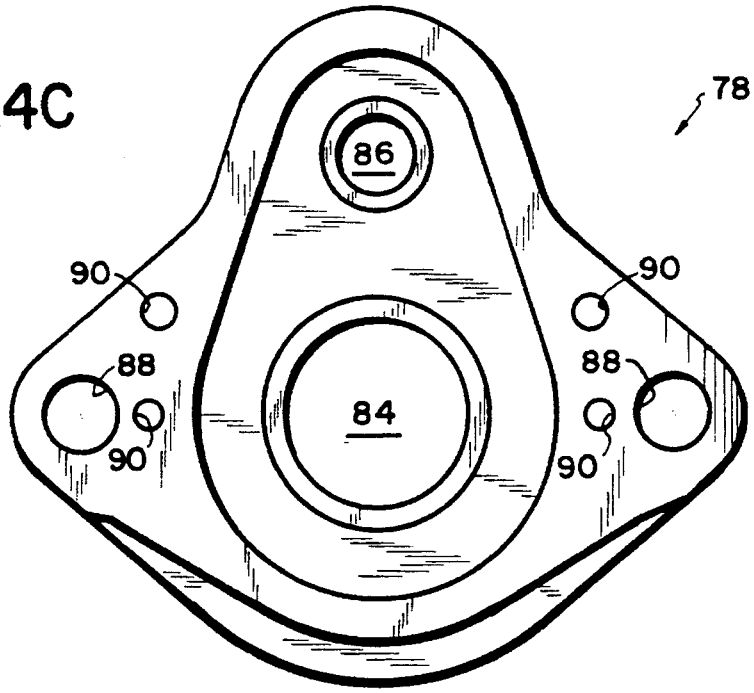

FIGS. 4 A through C, 5 A through C, and 6 A through C are more detailed figures of the three assemblies or housings 78, 80 & 82 shown in FIG. 2. A shown in these figures, all three housings 78, 80 & 82 of the hand throw means 30 form a center shaft 84 that permits the drive shaft 34 to pass through. In addition, the housings 78, 80 & 82 form an upper shaft 86 above the center shaft 84 in order to support the throw shaft 32.

Referring to FIGS. 4 A through C, the first housing 78 of the preferred embodiment is designed to accommodate the two gear configuration of the hand throw means 30. FIGS. 4A and C show that the apertures 84, 88 for the drive shaft and the mounting bolts pass all of the way through the hand throw means 30 while the apertures 86, 90 for the throw shaft and the module bolts stop short within the structure of the first housing 78. Thus, the drive shaft 34 and mounting bolts 72 are used to attach the hand throw means 30 to existing switch machines 10 whereas the throw shaft 32 and module bolts 74 are internalized as part of the hand throw means itself. FIG. 4B shows that the one side of the first housing 78 is open in order to provide access to the two gears 36, 38 that are contained within the first housing, for reasons such as maintenance.

Figure 5A:
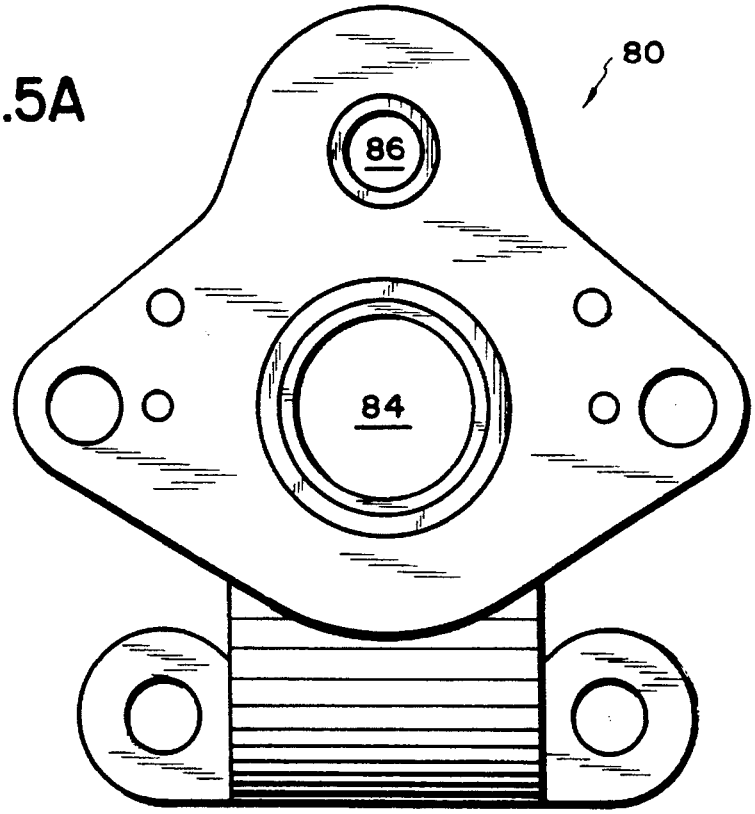
FIG. 5 A through C are planar and cross-sectional views of the second assembly of the preferred embodiment of FIG. 2.
Figure 5B:
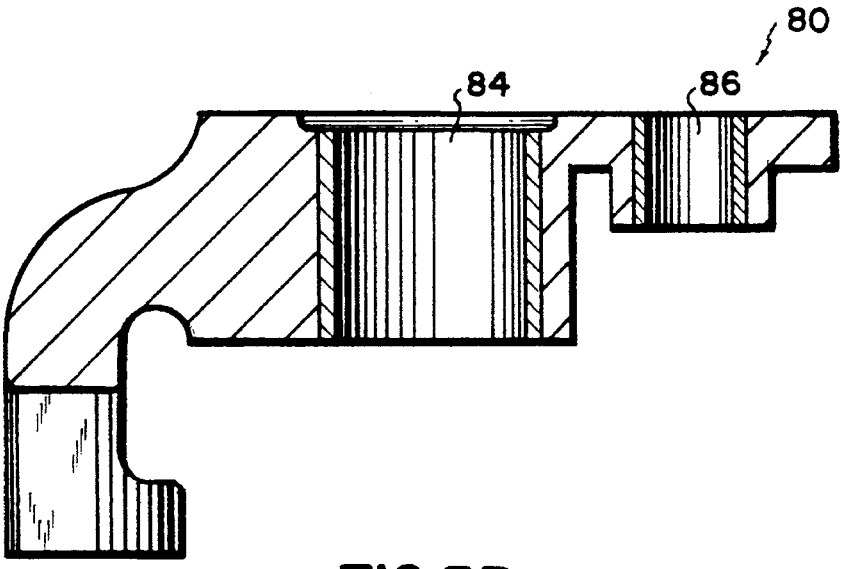
Figure 5C:
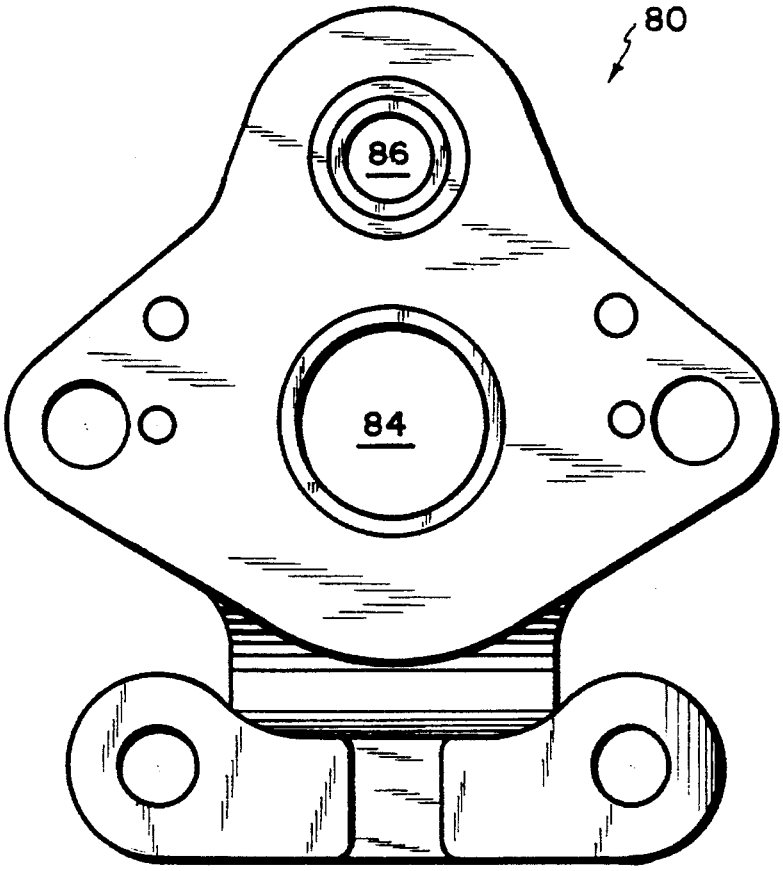

Referring to FIGS. 5 A through C, the second housing 80 of the preferred embodiment is designed to accommodate the ratchet mechanism 40. In addition, the lower portion of the second housing 80 extends outward to provide the face plate holes 76, mentioned above. Similar to the first housing 78, the second housing 80 shows one side that is open in order to provide access to the ratchet mechanism 40 for various reasons. The other side of the second housing 80 provides a support surface for containing the two gears 36, 38 within the first housing 78.

Figure 6A:
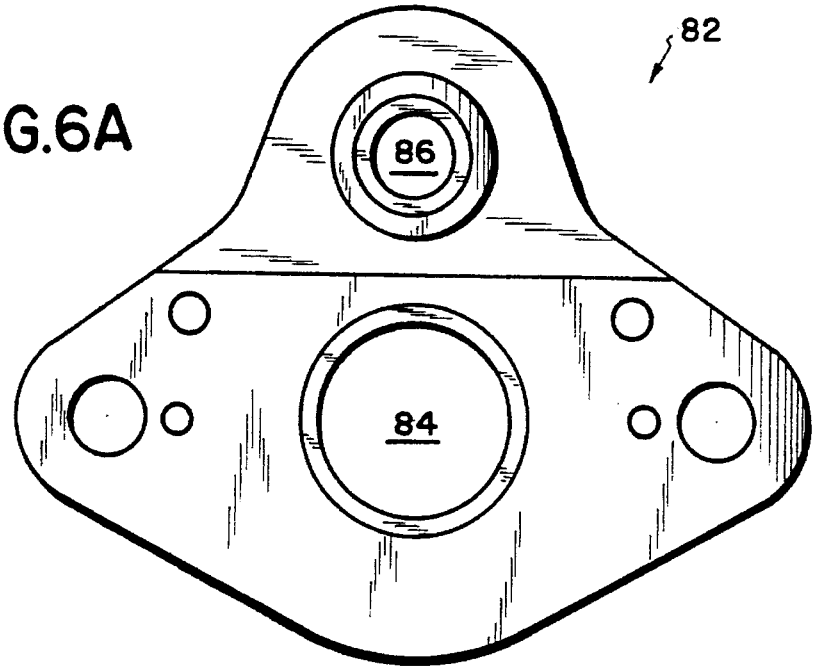
FIG. 6 A through C are planar and cross-sectional views of the third assembly of the preferred embodiment of FIG. 2.
Figure 6B:
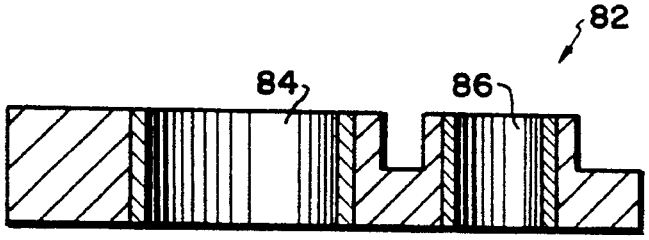
Figure 6C:
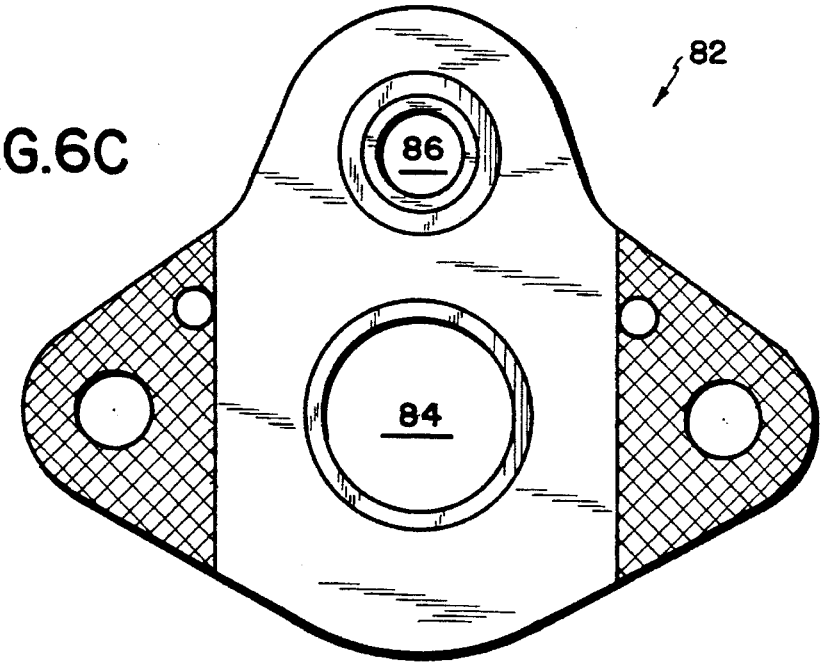

Referring to FIGS. 6 A through C, the third housing 82 of the preferred embodiment is designed to support the other side of the ratchet mechanism 40 that is not support by the second housing 80. Also, as mentioned about, the third housing 82 provides further support for the drive shaft 34 and the throw shaft 32.

The hand throw means 30 described herein is a self contained module that contains all machine elements required to perform its desired function, i.e., switching railway tracks. The module can be easily bolted to a switch machine during its assembly or subsequently in the field when the switch machine requires a hand throw capability. The module can be readily moved as a unit from one side of the switch machine to the other by removing the face plate on the switch machine, inserting the hand throw shaft into the machine and securing the module with bolts. Then, the hand throw arm must be installed on the appropriate side for left and right handed operation.

Another feature of the hand throw means of the present invention is the 2 to 1 mechanical advantage in favor of the hand throw operator provided by its unique gear system. Also, a ratchet means is provided that permits an operator to raise the throw handle to approximately the vertical position before the application of force is required. Operation of the ratchet means permits the operator to position himself in a favorable position for the application of force with minimum stress and strain on his or her body. The ratchet means includes a direction selector that permits torque to be applied in either a clockwise or counter-clockwise direction as desired by the operator.

Furthermore, the hand throw arm retains the capability of accommodating a mode selector and returning to a latch stand to be secured by a pad lock. For maintenance, the hand throw module is sealed and packed with a lubricant to ensure ease of operation, prevent entry of external contaminants and prevent rust and corrosion of internal components.

The invention having been thus described with particular reference to the preferred forms thereof, it will be obvious that various changes and modifications may be made therein without departing from the spirit and scope of the invention as defined in the appended claims.

Wherefore, we claim:

1. A switch machine for switching railway tracks from one position to another, having a hand throw means for causing a railway track switching operation to occur, said switch machine comprising:

a drive shaft;

a throw shaft located adjacent to said drive shaft for driving said drive shaft; and ratchet means operatively connected to said drive shaft and said throw shaft, including first means for rotating the drive shaft proportional to the rotation of said throw shaft and second means for rotating said throw shaft when said ratchet means is moved in a first direction and allowing said throw shaft to remain stationary when said ratchet means is moved in a second direction.

2. The switch machine of claim 1, wherein said first means for rotating comprises a first spur gear positioned about said drive shaft and a second spur gear positioned about said throw shaft engaged to said first spur gear.

3. The switch machine of claim 2, wherein said first spur gear has a circumferential length that is longer than a circumferential length of said second spur gear.

4. The switch machine of claim 1, wherein said second means for rotating comprises:

a ratchet pinion attached to said throw shaft for driving said throw shaft; and a pair of drive dogs for engaging said ratchet pinion such that only one of said pair of drive dogs is engaged to said ratchet pinion at a given time.

5. The switch machine of claim 4, wherein said second means for rotating comprises a hand throw arm for supporting said pair of drive dogs such that movement of said hand throw arm will cause the engaged one of said drive dogs to rotate said ratchet pinion.

6. The switch machine of claim 4, wherein said second means for rotating comprises a direction selector for determining which one of said pair of drive dogs is engaged to said ratchet pinion.

7. A switch machine for switching railway tracks from one position to another, having a hand throw means for causing a railway track switching operation to occur, said switch machine comprising:

a drive shaft;

a first assembly having an aperture for supporting said drive shaft;

a second assembly located adjacent to said first assembly for supporting the hand throw means;

means, supported by said first and second assemblies, for rotating said drive shaft when the hand throw means is moved in a first direction and allowing said drive shaft to remain stationary when the hand throw means is moved in a second direction;

said first and second assemblies being separable from the switch machine, and from each other, so that said rotating means may be removed and disassembled from the switch machine; and wherein a mode selector is supported, and separately movable, within said drive shaft.

8. A switch machine for switching railway tracks from one position to another, having a hand throw means for causing a railway track switching operation to occur, said switch machine comprising:

a drive shaft;

a first assembly having an aperture for supporting said drive shaft;

a second assembly located adjacent to said first assembly for supporting the hand throw means;

means, supported by said first and second assemblies, for rotating said drive shaft when the hand throw means is moved in a first direction and allowing said drive shaft to remain stationary when the hand throw means is moved in a second direction;

said first and second assemblies being separable from the switch machine, and from each other, so that said rotating means may be removed and disassembled from the switch machine; and a throw shaft supported by said first assembly for driving said drive shaft.

9. The switch machine of claim 8, wherein at least one end of said throw shaft is supported within said first assembly.

10. The switch machine of claim 8, further comprising ratchet means operatively connected to said drive shaft and said throw shaft, including means for rotating the drive shaft proportional to the rotation of said throw shaft and means for rotating said throw shaft when said ratchet means is moved in a first direction and allowing said throw shaft to remain stationary when said ratchet means is moved in a second direction.

* * * * *